US010807097B2

(12) United States Patent
Mogan et al.

(10) Patent No.: US 10,807,097 B2
(45) Date of Patent: Oct. 20, 2020

(54) VERTICAL SHAFT IMPACTOR

(71) Applicant: Heritage HD, LLC, Indianapolis, IN (US)

(72) Inventors: David A. Mogan, South Lyon, MI (US); William J. McDaniel, Zionsville, IN (US); James A. Scobey, Hopkins, MI (US); Patrick J. Fein, Dorr, MI (US); William J. Akers, Grain Valley, MO (US); Brent H. Sebright, Hopkins, MI (US)

(73) Assignee: Heritage Environmental Services, LLC, Indianapolis, IN (US)

( * ) Notice: Subject to any disclaimer, the term of this patent is extended or adjusted under 35 U.S.C. 154(b) by 454 days.

(21) Appl. No.: 15/648,928

(22) Filed: Jul. 13, 2017

(65) Prior Publication Data

US 2017/0304833 A1 Oct. 26, 2017

Related U.S. Application Data

(63) Continuation of application No. 13/998,525, filed on Nov. 7, 2013, now Pat. No. 9,707,564.

(60) Provisional application No. 61/723,532, filed on Nov. 7, 2012.

(51) Int. Cl.

| | |
|---|---|
| ***B02C 23/28*** | (2006.01) |
| ***B02C 13/28*** | (2006.01) |
| ***B02C 13/18*** | (2006.01) |

(52) U.S. Cl.

CPC ..... *B02C 13/28* (2013.01); *B02C 13/18* (2013.01); *B02C 2013/2808* (2013.01)

(58) Field of Classification Search

CPC ..... B02C 13/28; B02C 13/18; B02C 13/14; B02C 13/145; B02C 2013/2808; B02C 2013/2812

USPC ..... 241/151.1, 151.2, 275, 154

See application file for complete search history.

(56) References Cited

U.S. PATENT DOCUMENTS

| | | | |
|---|---|---|---|
| 1,798,465 | A | 3/1931 | Grindle et al. |
| 2,639,747 | A | 5/1953 | Burn et al. |
| 2,700,512 | A | 1/1955 | Denovan et al. |
| 3,160,354 | A | 12/1964 | Burkett et al. |
| 3,555,996 | A | 1/1971 | Schwarz et al. |

(Continued)

FOREIGN PATENT DOCUMENTS

| | | | |
|---|---|---|---|
| CA | 2890555 | A1 | 5/2014 |
| WO | 2014074126 | A1 | 5/2014 |

OTHER PUBLICATIONS

International Search Report and Written Opinion dated Feb. 7, 2014, relating to International Application No. PCT/US2013/000252, 12 pages.

(Continued)

*Primary Examiner* — Faye Francis

(74) *Attorney, Agent, or Firm* — Barnes & Thornburg LLP

(57) ABSTRACT

A vertical shaft impactor includes an impacting assembly that is configurable in a number of different ways, depending on the material to be processed by the impactor. The vertical shaft impactor includes an impacting chamber and an impacting assembly disposed in the chamber. The impacting assembly includes a number of rotors supported on a shaft, with the locations of the rotors being adjustable along the shaft. The rotors include adjustable structures for working and reducing materials in the vertical shaft impactor.

20 Claims, 12 Drawing Sheets

(56) References Cited

U.S. PATENT DOCUMENTS

| | | | | |
|---|---|---|---|---|
| 3,987,970 | A | 10/1976 | Burkett | |
| 4,144,167 | A | 3/1979 | Burkett et al. | |
| 4,151,794 | A | 5/1979 | Burkett | |
| 4,202,078 | A | 5/1980 | Malinak | |
| 4,214,716 | A | 7/1980 | Jadouin | |
| 4,690,338 | A | 9/1987 | Sayler et al. | |
| 4,989,796 | A | 2/1991 | Eide et al. | |
| 5,067,661 | A | 11/1991 | Eide et al. | |
| 5,192,029 | A | 3/1993 | Harris | |
| 5,205,500 | A | 4/1993 | Eide et al. | |
| 5,680,994 | A | 10/1997 | Eide et al. | |
| 5,685,500 | A | 11/1997 | Eide et al. | |
| 6,179,231 | B1 | 1/2001 | Csendes | |
| 6,325,306 | B1 * | 12/2001 | Gacanich | B02C 13/18 241/15 |
| 6,726,133 | B2 | 4/2004 | Hahn et al. | |
| 8,267,337 | B2 | 9/2012 | Webb | |
| 8,662,429 | B2 | 3/2014 | Matlin et al. | |
| 8,678,306 | B2 | 3/2014 | Watts | |
| 9,707,564 | B2 | 7/2017 | Mogan et al. | |
| 2009/0194624 | A1 | 8/2009 | Knueven et al. | |
| 2011/0215179 | A1 | 9/2011 | Watts | |
| 2014/0166795 | A1 | 6/2014 | Mogan et al. | |
| 2016/0045919 | A1 | 2/2016 | McDaniel et al. | |

OTHER PUBLICATIONS

Supplementary European Search Report and Opinion dated Aug. 2, 2016, relating to International Application No. PCT/US2013/000252, 5 pages.

* cited by examiner

VERTICAL SHAFT IMPACTOR

CROSS-REFERENCE TO RELATED APPLICATIONS

This application is a continuation of U.S. application Ser. No. 13/998,525, filed Nov. 7, 2013, which claims priority under 35 U.S.C. § 119(e), of U.S. Provisional Application No. 61/723,532, which was filed Nov. 7, 2012, each of which is incorporated by reference herein.

BACKGROUND

Mills or grinders can be used to process rubber, plastics, textiles, solid waste, and other material, to reduce its volume or to convert the material into a form that can be reused for other purposes.

SUMMARY

According to at least one aspect of this disclosure, a vertical shaft impactor to process a plurality of different materials includes a housing defining an impacting chamber having a plurality of generally horizontal shelves secured to the periphery of the housing and extending into the impacting chamber; and an impacting assembly disposed in the impacting chamber, the impacting assembly comprising a generally vertical shaft supported by the housing, a plurality of rotors concentric with the shaft and rotatable relative to the housing, a plurality of key slots defined in the generally vertical shaft at predefined intervals along the generally vertical shaft, and a plurality of keys selectively disposable in the key slots, each key including a nub for supporting one of the rotors along the shaft, the keys being interchangeable to vary the vertical position of the rotor relative to the shaft.

The plurality of rotors may include a plurality of generally vertically spaced impacting rotors and an impeller rotor, and the impeller rotor may be located vertically below the impacting rotors. Each impacting rotor may include a generally planar cutting disk and a selectable number of radially-extending cutting assemblies removably mounted to the cutting disk; and each cutting assembly may include a hammer supported by an upwardly facing top surface of the cutting disk, a cutting blade supported by the hammer, and a fan blade adjacent a downwardly facing lower surface of the cutting disk. The hammer, the cutting blade, and the fan blade may share a common bolt pattern through the cutting disk. The common bolt pattern may include three bolts arranged in a generally straight line defined by a ray extending from the center of the generally vertical shaft. The cutting disk may include a plurality of holes defined therein, and the holes may define a plurality of selectable mounting positions for the cutting assemblies. The number of cutting assemblies may be one of 4, 6, and 8, and the cutting assemblies may be mounted to the cutting disk in a generally regular pattern about the disk so that the interval between the cutting assemblies may decrease with an increase in the number of cutting assemblies. The number of cutting assemblies may be variable based on a characteristic of a material to be processed by the vertical shaft impactor. The hammer may have a configuration selectable from a plurality of hammer configurations based on a characteristic of a material to be processed by the vertical shaft impactor. The plurality of hammer configurations may include one or more of a bar, a mallet, a beveled, and a serrated configuration. The hammer may include a first cutting edge and a second cutting edge spaced from the first cutting edge by a width of the hammer. The impeller rotor may include a generally planar fan disk and a plurality of radially-extending fan blades mounted to an upwardly-facing top surface of the fan disk. The plurality of fan blades of the fan disk may include a fixed number of fan blades. The fixed number of fan blades may be 4. Each fan blade of the fan disk may have a flange mounted to the top surface of the fan disk and a blade portion extending generally vertically upwardly from the flange to define an angle of about 90 degrees with the flange. Each fan blade has at least one generally triangular end connecting the flange with the blade portion. The blade portion may have a vertical height configuration selectable from a plurality of vertical height configurations based on a characteristic of a material to be processed by the vertical shaft impactor. Each fan blade may be mounted to the fan disk using a bolt pattern comprising four bolts arranged in a generally straight line defined by a ray extending from the center of the generally vertical shaft. The plurality of rotors may be spaced from each other by a vertical distance that is variable based on a characteristic of a material to be processed by the vertical shaft impactor. The plurality of rotors may include first, second, and third impacting rotors, and the first and second impacting rotors may be vertically spaced by a first interval, the second and third rotors may be vertically spaced by a second interval, and the second interval may not be the same as the first interval. The plurality of rotors may include an impeller rotor located below the impacting rotors and vertically spaced from the third impacting rotor by a third interval, and the third interval may not be the same as one or more of the first and second interval. Each of the plurality of keys may include a base sized to be received by a key slot and a nub extending outwardly away from the base, where the nub may be configured to support one of the rotors. The nub may have a vertically upwardly facing surface configured to removably engage a vertically downwardly facing surface of a rotor. The vertically upwardly facing surface of the nub may be generally perpendicular to the vertical shaft when the key is positioned in the key slot. The rotor may include a generally planar disk having a downwardly facing surface, and the upwardly facing surface of the nub may be configured to removably engage the downwardly facing surface of the disk. The base may have a length, the nub may have a length, and the length of the nub may be less than the length of the base. The plurality of keys may include a first key and a second key, and the length of the nub of the second key may be larger than the length of the nub of the first key. The length of the nub may be defined based on a characteristic of material to be processed by the vertical shaft impactor. The lower surface of each of the cutting disks may be vertically spaced from one of the shelves by a gap. The gap may have a minimum height in the range of about 1 inch. The fan blade of the cutting assembly may include a flange mounted to the bottom side of the cutting disk and a blade portion extending generally downwardly from the flange to define an angle with the flange that is greater than 90 degrees. The cutting blade of the cutting assembly may include a flange mounted to a top surface of the hammer, a blade portion extending generally upwardly from the flange to define an angle with the flange in the range of about 90 degrees, and at least one triangular end connecting the flange with the blade portion.

According to at least one aspect of this disclosure, an impacting rotor for a vertical shaft impactor to process a plurality of different materials may include a generally planar cutting disk removably mountable to a rotatable vertical shaft of the vertical shaft impactor; and a plurality of radially-extending cutting assemblies removably mounted to the cutting disk, each cutting assembly comprising a hammer supported by an upwardly facing top surface of the cutting disk, a cutting blade supported by the hammer, and a fan blade adjacent a downwardly facing lower surface of the cutting disk, the hammer, the cutting blade, and the fan blade being generally vertically aligned.

The number of cutting assemblies mounted to the cutting disk may be variable based on a characteristic of material to be processed by the vertical shaft impactor. e variable number of cutting assemblies may be in the range of zero to ten. The hammer may be selected from a plurality of hammers having different hammer configurations. The plurality of different hammer configurations may include one or more of a bar, a mallet, a beveled, and a serrated configuration. The cutting disk may include a plurality of holes defined therein and may be arranged for the mounting of a variable number of cutting assemblies. The impacting rotor may include a first plurality of holes to mount four cutting assemblies to the cutting disk, a second plurality of holes to mount six cutting assemblies to the cutting disk, and a third plurality of holes to mount eight cutting assemblies to the cutting disk.

According to at least one aspect of this disclosure, a cutting disk for an impacting rotor of a vertical shaft impactor to process a plurality of different materials may include a first plurality of holes to mount four cutting assemblies to the cutting disk; a second plurality of holes to mount six cutting assemblies to the cutting disk; and a third plurality of holes to mount eight cutting assemblies to the cutting disk, each cutting assembly being removably mountable to the cutting disk, and each cutting assembly comprising a hammer supported by an upwardly facing top surface of the cutting disk, a cutting blade supported by the hammer, and a fan blade mountable adjacent a downwardly facing lower surface of the cutting disk, the hammer, the cutting blade, and the fan blade being generally vertically aligned.

According to at least one aspect of this disclosure, a method for configuring a vertical shaft impactor to process material, the vertical shaft impactor comprising a plurality of impacting rotors rotatable with a vertical shaft, may include mounting a first number of cutting assemblies to a cutting disk of an impacting rotor based on a first material to be processed by the vertical shaft impactor; and mounting a second number of cutting assemblies to the cutting disk of the impacting rotor based on a second material to be processed by the vertical shaft impactor, the second material having at least one characteristic different from the first material. The method may include changing the number of cutting assemblies mounted to the cutting disk without modifying the cutting disk.

According to at least one aspect of this disclosure, a method for configuring a vertical shaft impactor to process material, the vertical shaft impactor comprising a plurality of impacting rotors rotatable with a vertical shaft, may include mounting an impacting rotor on a first key supported in a slot of the vertical shaft based on a first material to be processed by the vertical shaft impactor; and mounting the impacting rotor on a second key supported in the slot of the vertical shaft based on a second material to be processed by the vertical shaft impactor, the second material having at least one characteristic different from the first material, and the second key defining a different vertical position of the impacting rotor than the first key. The method may include inserting the first key into the slot in the vertical shaft to mount the impacting rotor at a first vertical position, and inserting the second key into the slot to mount the impacting rotor at a second vertical position. The first key may have a first nub, the second key may have a second nub, and the second nub may have a different size than the first nub.

According to at least one aspect of this disclosure, a method for configuring a vertical shaft impactor to process material, the vertical shaft impactor comprising a plurality of impacting rotors rotatable with a vertical shaft, each impacting rotor comprising a cutting disk and a plurality of cutting assemblies mounted thereto, and each cutting assembly comprising a hammer supported by an upwardly facing top surface of the cutting disk, a cutting blade supported by the hammer, and a fan blade adjacent a downwardly facing lower surface of the cutting disk, the hammer, the cutting blade, and the fan blade being generally vertically aligned, may include mounting a first hammer to the cutting disk, the first hammer having a first hammer configuration based on a first material to be processed by the vertical shaft impactor; and mounting a second hammer to the cutting disk, the second hammer having a second hammer configuration based on a second material to be processed by the vertical shaft impactor, the second material having at least one characteristic different from the first material, and the second hammer configuration being different than the first hammer configuration. The method may include selecting the first and second hammer configurations from a plurality of cutting edge configurations. The plurality of hammer configurations may include one or more of bar, beveled, serrated, and mallet configurations.

BRIEF DESCRIPTION OF THE DRAWINGS

This disclosure is illustrated by way of example and not by way of limitation in the accompanying figures. The figures may, alone or in combination, illustrate one or more embodiments of the disclosure. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

DETAILED DESCRIPTION

Figure 1:
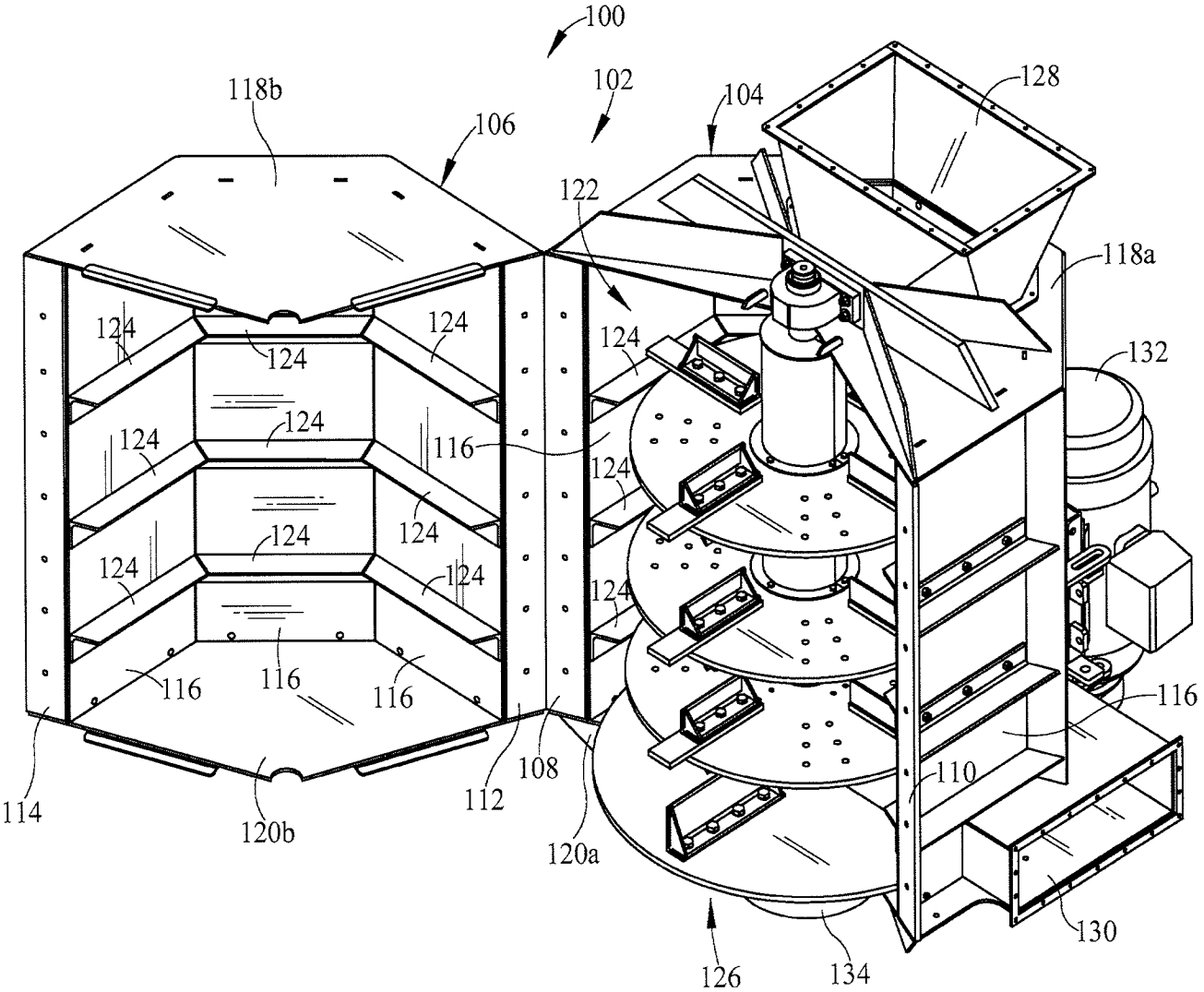
FIG. 1 is a simplified perspective view taken from above the assembly, of at least one embodiment of a vertical shaft impactor with the housing open to show an impacting chamber with an impacting assembly disposed therein.

While the concepts of the present disclosure are susceptible to various modifications and alternative forms, specific embodiments thereof are shown by way of example in the drawings and are described in detail below. It should be understood, however, that there is no intent to limit the concepts of the present disclosure to the particular forms disclosed, but on the contrary, the intention is to cover all modifications, equivalents, and alternatives consistent with the present disclosure and the appended claims.

Referring now to FIG. 1, a vertical shaft impactor 100 includes an impacting assembly 126, which is situated inside an impacting chamber 122. The impacting assembly 126 is configurable in a number of different ways so that the impactor 100 can effectively and/or efficiently process a variety of different types of material. For example, the impacting assembly 126 has a number of interchangeable components. The configuration of the impacting assembly 126 can be easily modified (e.g., without requiring additional machining or a complete disassembly) by moving the impacting assembly 126 out of the impacting chamber 122 and adding and/or removing the appropriate components.

The impacting chamber 122 is defined by a housing 102. The housing 102 includes housing portions 104, 106. In FIG. 1, the impacting chamber 122 is shown in an open position to expose the impacting assembly 126. When the impactor 100 is in operation, flanges 108, 110 of the housing portion 104 are secured (e.g., by bolts or other suitable fasteners) to corresponding flanges 112, 114 of the housing portion 106 to close the impacting chamber 122. Illustratively, the flange 108 is hinged to the flange 112, although this need not be the case.

The housing 102 also includes a sidewall made up of a number of generally vertically-oriented sidewall sections 116, a top wall including top wall portions 118*a*, 118*b*, and a bottom wall including bottom wall portions 120*a*, 120*b*. In the illustrated embodiment, the housing 102 is generally octagonally-shaped and as such, includes eight sidewall sections 116, with the housing portion 104 including five sidewall sections 116 and the housing portion 106 including three sidewall sections 116. In other embodiments, the housing 102 may take any other suitable form including any number of sidewall sections 116, as may be needed according to the requirements of a particular design. In the impacting chamber 122, a number of generally horizontal shelves 124 are mounted at predefined intervals along the vertical length of the sidewall sections 116, such that the shelves 124 are generally vertically aligned around the periphery of the housing 102.

An inlet 128 is supported by the top wall 118*a*, and defines an opening into the impacting chamber 122 through which material to be processed by the impactor 100 is fed. Material processed by the impactor 100 exits the impacting chamber 122 through an outlet 130. A drive unit (e.g., a motor) 132 drives the operation of the impacting assembly 126 by connecting with a pulley 134 (via a belt or chain, for example).

Figure 2:
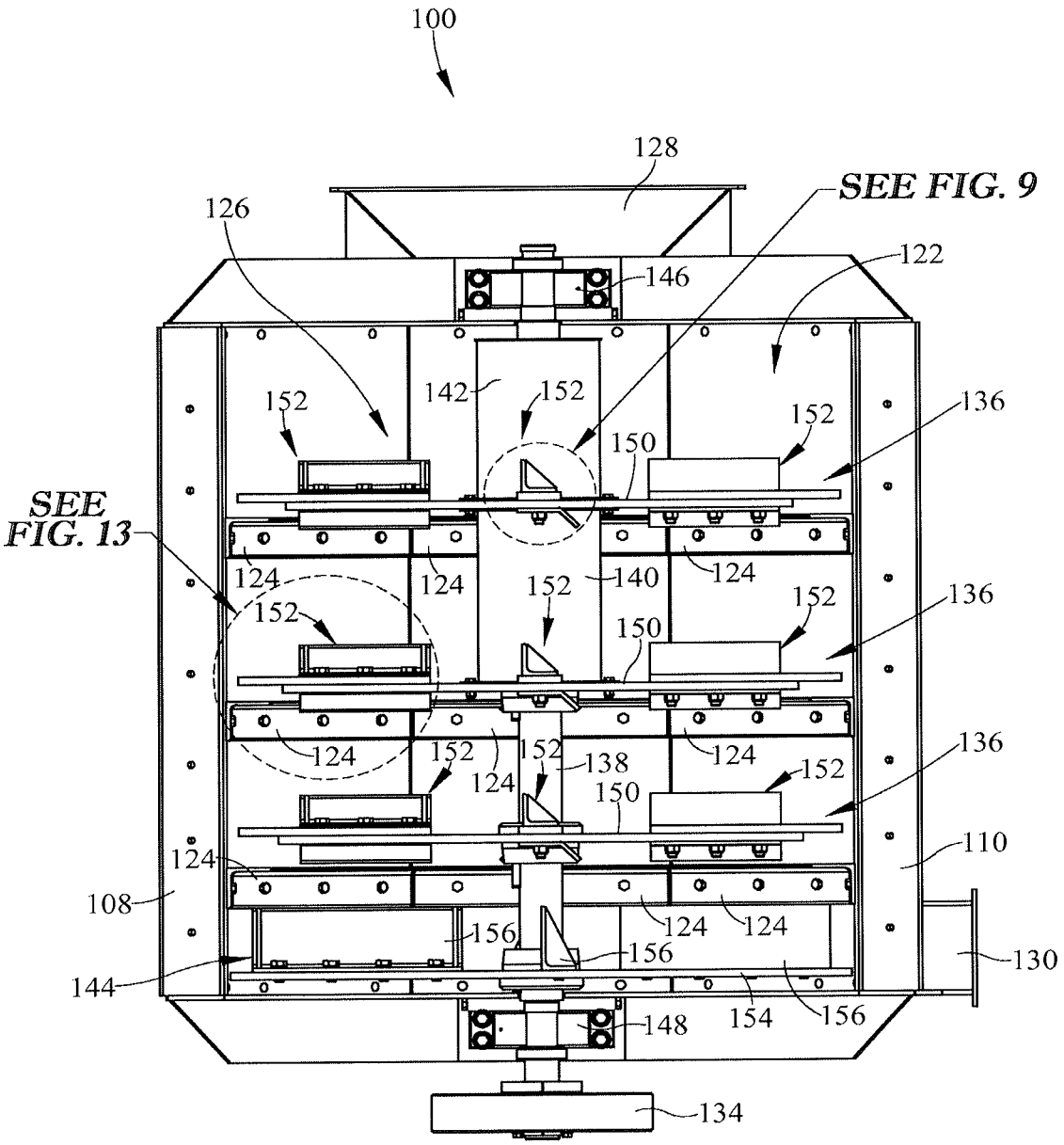
FIG. 2 is a simplified elevational view of the impacting chamber of the vertical shaft impactor of FIG. 1, with the hinged portion of the housing removed.

Referring now to FIG. 2, portions of the illustrative impacting assembly 126 are shown in greater detail. The impacting assembly 126 includes a number of impacting rotors 136 and an impeller rotor 144, which are mounted at predefined intervals along a generally vertical shaft 138. In the illustrative embodiment, cylinders 140, 142, which have different diameters or thicknesses than the shaft 138 (e.g., the cylinders 140, 142 have a larger diameter than the shaft 138), may be disposed about a portion of the shaft 138. That is, in some embodiments, the shaft 138 may have generally the same diameter along its length, and the rotors 136, 144 may be mounted to the shaft 138 as described herein, with a cylinder 140, 142 being supported by a top surface of the rotor 136, 144 as the case may be. In other words, individual cylinders 140, 142 may be disposed about the shaft 138, above or between the various rotors 136, 144 as needed. In some embodiments, one or more cylinders 140, 142 may be provided around upper portions of the shaft 138 to facilitate downwardly movement of material through the impacting assembly 126, or for other reasons.

The shaft 138 is secured to the housing 102 at its longitudinal ends by bearings 146, 148. That is, the illustrative impacting assembly 126 is configured so that the shaft 138 is rotatably driven by the drive unit 132 and the rotors 136, 144 rotate with the shaft 138. In other embodiments, however, the shaft 138 may be mounted to the housing 102 by brackets rather than bearings 146, 148, such that the rotors 136, 144 rotate about, rather than with, the shaft 138. For instance, the rotors 136, 144 rather than the shaft 138 may be driven by the drive unit 132, or the rotors 136, 144 may be driven by individual drive units operably coupled to each rotor 136, 144, in place of or in addition to the drive unit 132.

Each of the impacting rotors 136 includes a cutting disk 150 and a number of cutting assemblies 152 mounted thereto in a generally regular pattern about the cutting disk 150. The cutting disk 150 is a generally planar, circular disk with a number of holes 164 pre-drilled therethrough. A portion of each cutting assembly 152 is mounted to a top surface of the cutting disk, and another portion of each cutting assembly 152 is mounted to a bottom surface of the cutting disk, as described in more detail below. Also as described further below, the number of cutting assemblies 152 mounted to the cutting disk 150, as well as the configuration of each cutting assembly 152, are variable based on the material to be processed by the impactor 100.

The impeller rotor 144 includes a fan disk 154 and a number of fan blades 156 mounted to a top surface of the fan disk 154. In the illustrative embodiment, the number of fan blades 156 mounted to the fan disk 154 is predetermined and not variable. In other embodiments, however, different types of fan disks may be used, including fan disks having a variable number of fan blades. Additionally, as described below, the configuration of the fan blades 156 (e.g., the blade height, angle, etc.) may be varied based on the material to be processed by the impactor 100, in some embodiments. In some embodiments, the fan disk 154 has a different diameter than one or more of the cutting disks 150. For example, in the illustrative embodiment, the cutting disks 150 each have generally the same diameter while the fan disk 154 has a larger diameter than the cutting disks 150.

Figure 3:
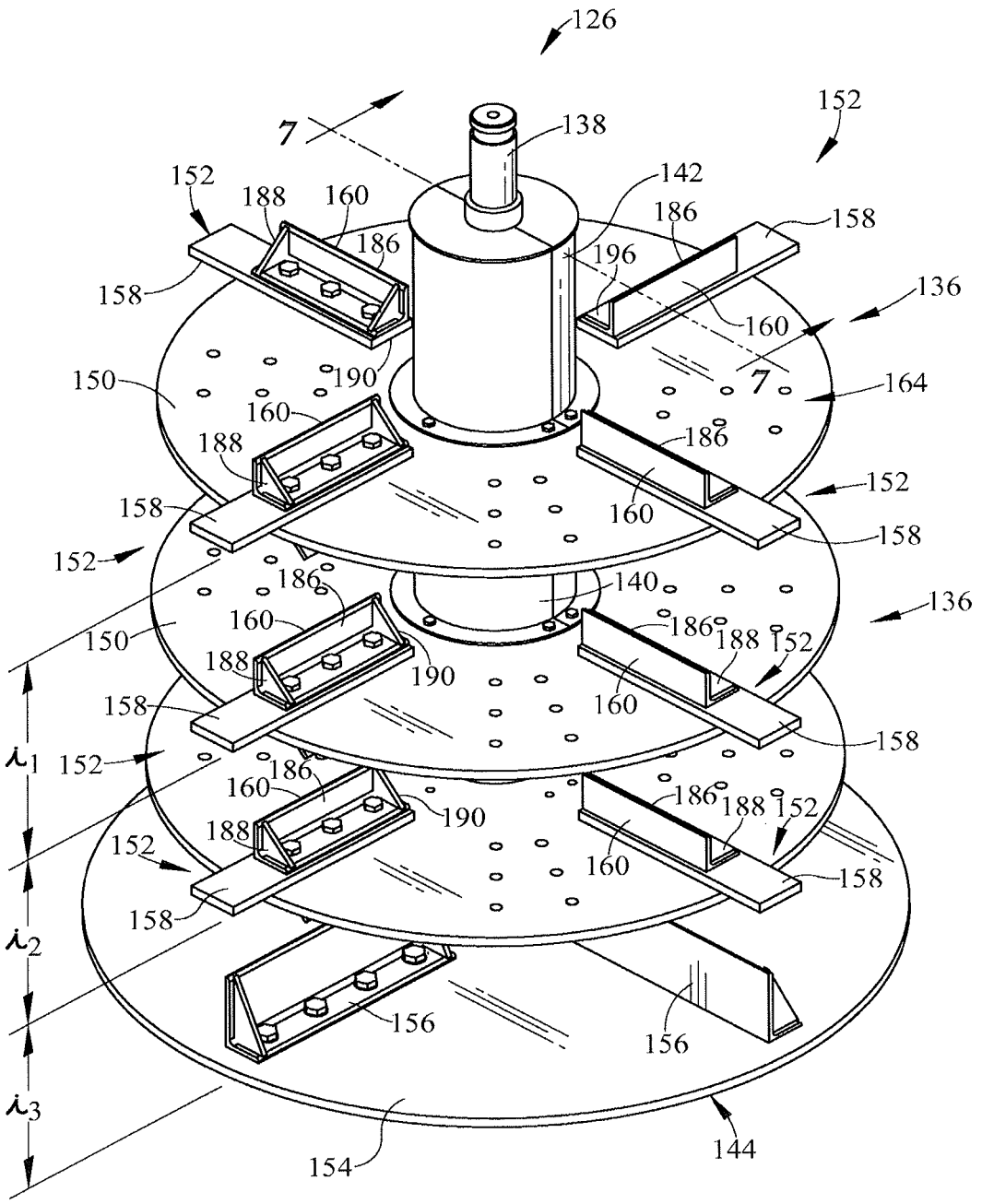
FIG. 3 is a simplified perspective view of the impacting assembly of the vertical shaft impactor of FIG. 1, taken from above the assembly.
Figure 4:
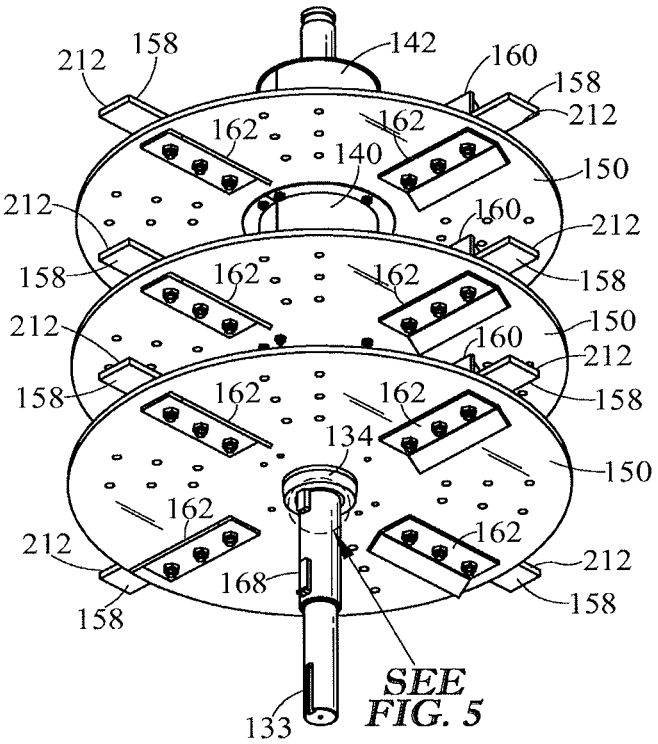
FIG. 4 is a simplified perspective view of the impacting assembly of FIG. 1, taken from below the assembly, with the impeller rotor removed.
Figure 7:
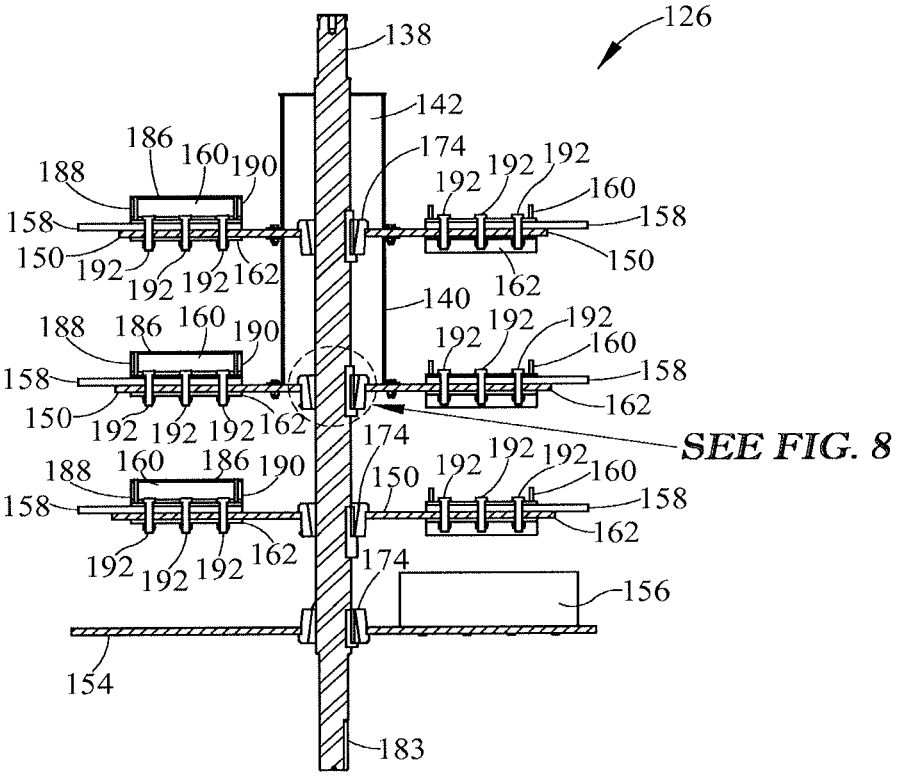
FIG. 7 is a simplified sectional view of the impacting assembly of FIG. 4.

Referring now to FIGS. 3-4 and FIG. 7, further details of the cutting assemblies 152 are shown. The cutting assemblies 152 have a generally elongated (e.g., bar- or rectangularly shaped) footprint that extends radially outwardly from an inner portion of the cutting disk 150. Each cutting assembly 152 has a counterpart cutting assembly 152 located opposite (e.g., 180 degrees) thereto, such that the cutting assemblies 152 are generally evenly spaced about the cutting disk 150.

Each of the illustrative cutting assemblies 152 includes a hammer 158, a cutting blade 160, and a fan blade 162. The hammer 158 and the fan blade 162 are mounted to opposite sides of the cutting disk 150 through holes 164 in the cutting disk 150. More specifically, the hammer 158 is mounted to the top side of the cutting disk 150 and the fan blade 162 is mounted to the bottom side of the cutting disk 150. The cutting blade 160 is mounted to a top (e.g., upwardly facing) surface of the hammer 158.

An outer end 212 of the hammer 158 extends outwardly beyond the outer, circumferential, edge of the cutting disk 150. The remaining portion of the hammer 158 is generally vertically aligned with the cutting blade 160 and the fan blade 162, so that the hammer 158, the cutting blade 160, and the fan blade 162 share a common bolt pattern through the cutting disk 150. In the illustrative embodiment, the hammer 158, the cutting blade 160, and the fan blade 162 share a bolt pattern that includes a number of bolts (e.g., three) 192 arranged in a generally straight line defined by a ray that extends from the center of the shaft 138.

As shown FIGS. 3 and 4, the rotors 136, 144 are concentric with the shaft 138 and rotatable with respect to the housing 102. The rotors 136, 144 are mounted to the shaft 138 at predefined, adjustable intervals (e.g., $i_1$, $i_2$, and $i_3$). That is, the vertical position of each or any of the rotors 136, 144 relative to the shaft 138 may be changed, e.g., based on the material to be processed by the impactor 100. For example, the spacing or intervals $i_1$, $i_2$, and $i_3$ of the rotors 136, 144 may be varied as needed or desired to more effectively or efficiently process different types of materials. For instance, the processing of heavier or more durable material (e.g., carpet) may benefit from different spacing of the rotors 136, 144 than is used for lighter or more brittle material (e.g., container plastic).

Figure 5:
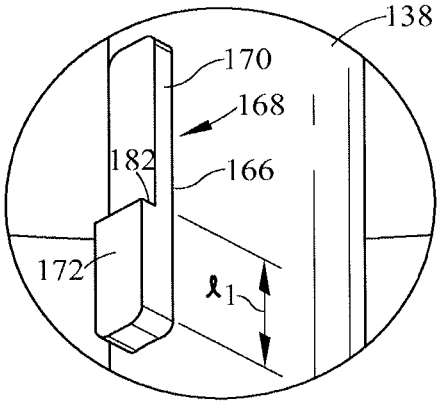
FIG. 5 is a simplified enlarged perspective view of a portion of the impacting assembly of FIG. 4.

Referring now to FIGS. 4-6 and 8, further details of the shaft 138, which enable the adjustment of the vertical position of the rotors 136, 144, are shown. The shaft 138 has defined therein, at predefined intervals, a number of key slots 166. The key slots 166 are, illustratively, generally vertically aligned along the length of the shaft 138, but this need not be the case. An adjustment key 168 is removably disposed in each key slot 166. The adjustment key 168 has an elongated base portion 170, which is sized for engagement with the key slot 166, and a nub 172, which is configured to support a rotor 136, 144 on the shaft 138. As shown in FIG. 5, the nub 172 may define a length, $l_1$.

Figure 8:
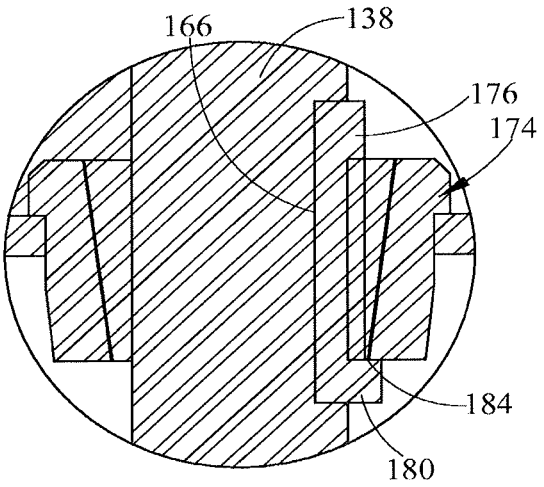
FIG. 8 is a simplified enlarged sectional view of a portion of FIG. 7.

The nub 172 has a vertically upwardly facing surface 182 that is generally perpendicular to the shaft 138 when the key 168 is positioned in the key slot 166. The upwardly facing surface 182 of the nub 172 is configured to removably engage the vertically downwardly facing surface of a rotor 136, 144. More specifically, as shown in FIGS. 4 and 8, a rotor 136, 144 may include a collar 174 that is concentric with the shaft 138 and supports the remaining portions of the rotor 136, 144 above the nub 172. Thus, the surface 182 of the nub 172 may engage a vertically downwardly facing surface of the collar 174.

Figure 6:
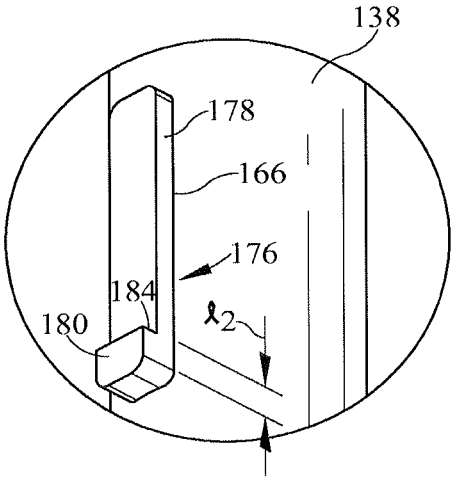
FIG. 6 is a simplified enlarged perspective view of another embodiment of the portion of the impacting assembly of FIG. 4.

The vertical position of a rotor 136, 144 along the shaft 138 can be adjusted by installing in the key slot 166 a key 176 having a different configuration of the nub 172 than the key 168. That is, a number of different, interchangeable keys 168, 176 may be provided to vary the interval or spacing between the rotors along the shaft 138 by adjusting the size of the nub 172. One example of an alternative key 176 is shown in FIGS. 6 and 8. The key 176 has a base portion 178, which corresponds to the base portion 170 of the key 168 and is sized to engage the slot 166. The key 176 has a nub 180, which has a vertically upwardly facing surface 184 to support a rotor 136, 144. The nub 180 defines a length $l_2$, which is, illustratively, shorter than the length $l_1$ of the nub 172 of the key 168. As such, when positioned in a key slot 166, the key 168 will result in a rotor 136, 144 having a position that is higher (nearer to the top end of the shaft 138) than the key 176. In this way, the vertical position of each or any of the rotors 136, 144 can be adjusted by swapping out the key 168, 176. That is to say, not only can the rotors be positioned more closely together or farther apart as needed, but additionally, the individual rotors 136, 144 need not be equidistantly vertically spaced from one another, in some embodiments.

Figure 9:
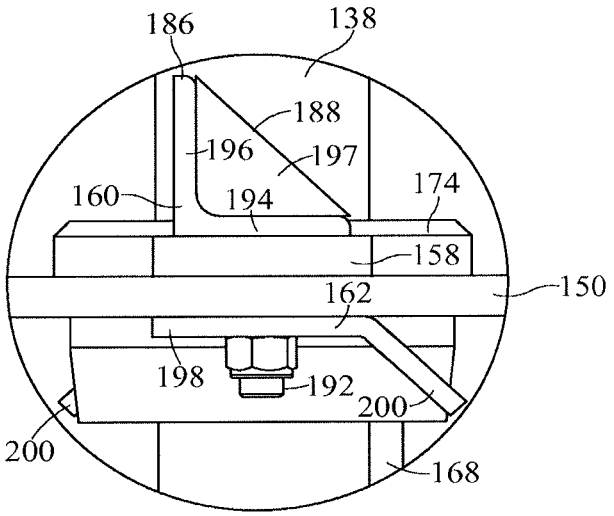
FIG. 9 is a simplified enlarged elevational view of a portion of FIG. 2.

Referring now to FIGS. 7 and 9, further details of the impacting assembly 126 are shown. Specifically, FIG. 7 shows the generally vertical alignment of the cutting blade 160, the hammer 158, and the fan blade 162 of the impacting rotors 136, as well as the common bolt pattern including the bolts 192. The cutting blade 160 includes a flange 194 and a blade portion 196, which extends generally vertically upwardly (e.g., is cantilevered) from the flange 194 at an angle in the range of about 90 degrees. The cutting blade 160 includes a number of cutting edges 186, 188, and 190. The cutting edge 188 extends along a top edge of a longitudinal length of the blade portion 196. The cutting edges 188, 190 extend along a peripheral edge of each of the generally triangular ends 197, each of which connects the flange 194 with the blade portion 196 at its longitudinal ends. The flange 194 has a plurality of holes defined therein to align with the bolt pattern of the hammer 158 and the fan blade 162.

As shown in FIG. 9, the fan blades 162 of the impacting rotors 136 each have a flange 198 and a blade portion 200 extending at an angle of greater than 90 degrees from the blade portion 200. The flange 98 has a plurality of holes defined therein to align with the bolt pattern of the hammer 158 and the cutting blade 160. Generally, as shown in the drawings, the cutting blades 160, the fan blades 162, and the base portion of the hammers all have approximately the same length, in some embodiments.

Figure 10:
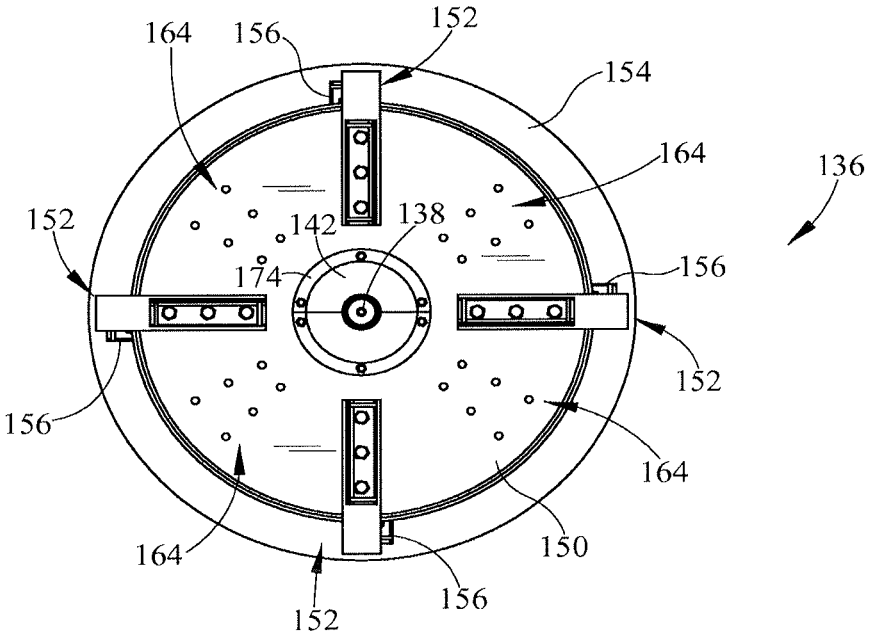
FIG. 10 is a simplified top plan view of at least one embodiment of an impactor rotor.
Figure 11:
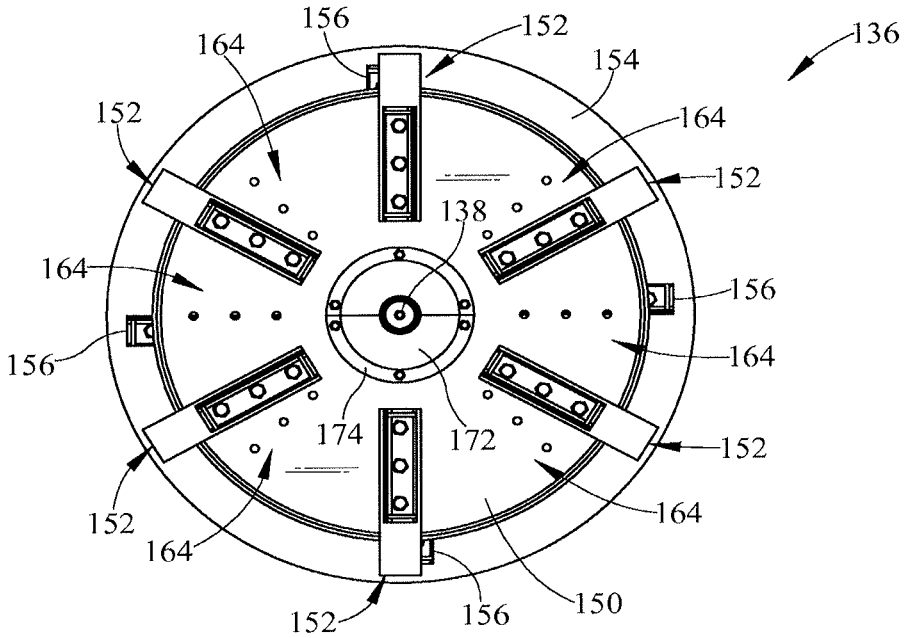
FIG. 11 is a simplified top plan view of at least one embodiment of an impactor rotor.
Figure 12:
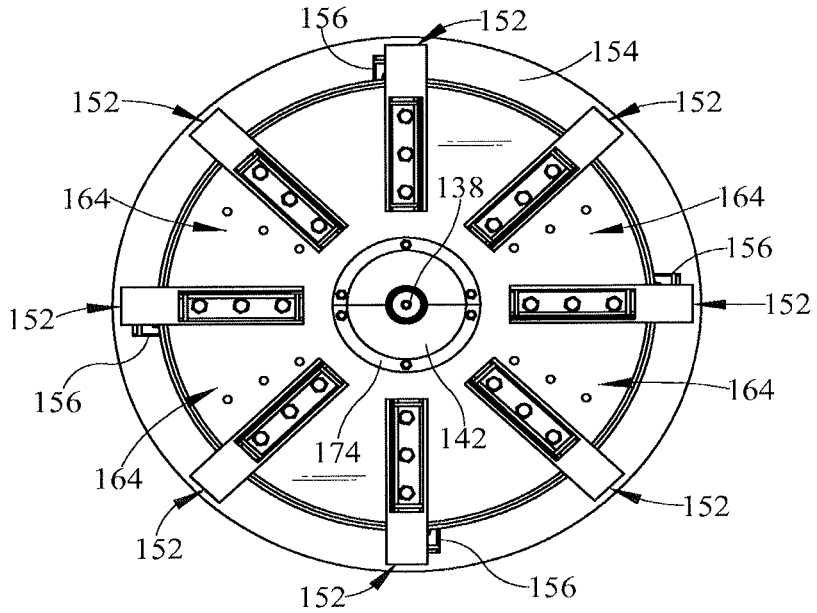
FIG. 12 is a simplified top plan view of at least one embodiment of an impactor rotor.

In the configuration of FIGS. 1-4, each of the impacting rotors 136 includes four cutting assemblies. However, the impacting rotors 136 are configured to support a variable number of cutting assemblies, as shown in FIGS. 10, 11, and 12. FIG. 10 shows a configuration of the impacting rotor 136 with four cutting assemblies 152 mounted to the top surface of the cutting disk 150. FIG. 11 shows a configuration of the impacting rotor 136 with six cutting assemblies 152 mounted to the top surface of the cutting disk 150. FIG. 12 shows a configuration of the impacting rotor 136 with eight cutting assemblies 152 mounted to the top surface of the cutting disk 150. A greater or lesser number of cutting assemblies 152 may be used, depending on the material to be processed by the impactor 100. For example, a greater number of cutting assemblies 152 may provide faster processing of heavy or fibrous material, while a smaller number of cutting assemblies 152 may be suitable for thinner or lighter material. As can be seen in FIGS. 10-12, the spacing or interval between the cutting assemblies 152 decreases as the number of cutting assemblies increases.

To change the number of cutting assemblies 152 mounted to the cutting disk 150, cutting assemblies 152 simply need to be added or removed depending on the desired number of cutting assemblies. For example, to change from a four-cutting assembly configuration to a six-assembly configuration, two opposing cutting assemblies are removed and four cutting assemblies 152 are added, using the appropriate holes 164 in the cutting disk 150 to provide the desired spacing between the cutting assemblies 152. To change from a four-cutting assembly configuration to an eight-assembly configuration, four cutting assemblies 152 are added using the appropriate holes 164. To change from a six-cutting assembly configuration to an eight-assembly configuration, two cutting assemblies 152 are added and four of the existing cutting assemblies 152 are realigned using the appropriate holes 164 to provide the desired spacing or intervals between the cutting assemblies 152. As mentioned above, the holes 164 are pre-drilled in the cutting disk 150 so that re-machining is not required and the same cutting disk 150 can be used for all of the various cutting assembly configurations that may be desired.

Figure 13:
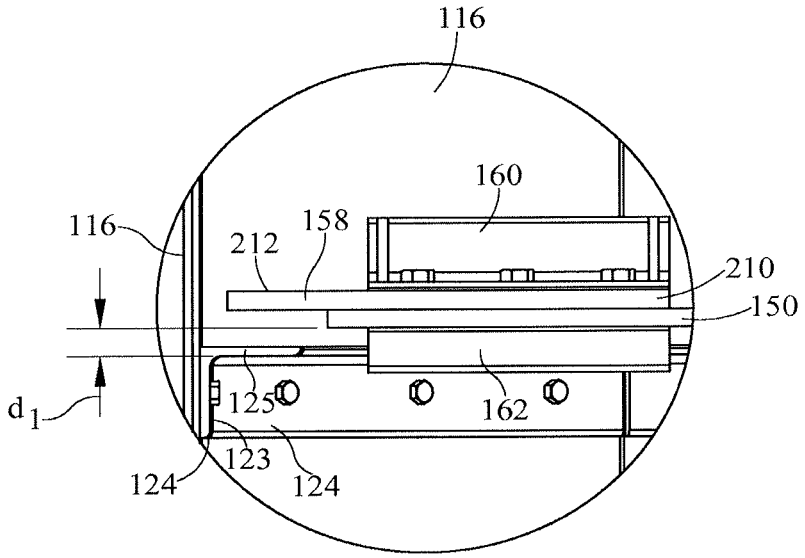
FIG. 13 is a simplified enlarged elevational view of a portion of FIG. 2, showing a portion of an impactor rotor in relation to an interior wall and shelf of the housing.

Referring now to FIG. 13, further details of the impacting rotors 136 relative to the shelves 124 are shown. Each shelf 124 has a flange 123, which is secured to sidewall section 116 (via, e.g., bolts or other suitable fasteners), and a cantilevered portion 125, which extends horizontally inwardly into the impacting chamber 122. The distal end 212 of the hammer 158 extends horizontally outwardly past the outer edge of the cutting disk 150, as mentioned above, but there remains sufficient clearance between the end 212 and the walls 116 of the impacting chamber 122 and the cantilevered portion 125 for material processed by the impacting rotor 136 to flow generally vertically downwardly to the next level of the impacting assembly 126 through that gap. Additionally, the impacting rotor 136 is mounted to the shaft 138 (via a key 168, 176) so that a gap having a size $d_1$ is defined between the bottom surface of the cutting disk 150 and the cantilevered portion 125 of the shelf 124. In some embodiments, the minimum gap size $d_1$ is in the range of about one inch.

Figure 16:
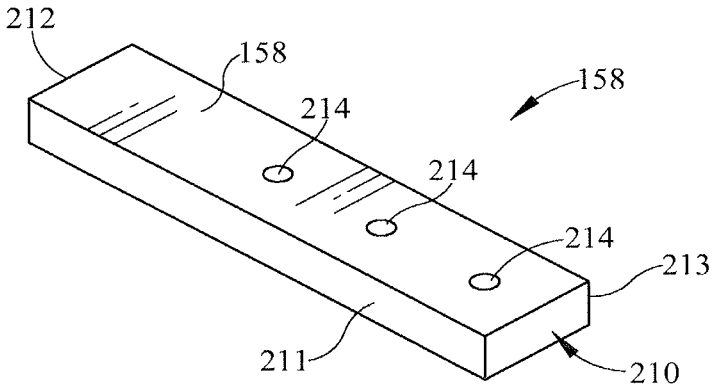
FIG. 16 is a simplified perspective view of at least one embodiment of a hammer for an impactor rotor.

In the configurations of FIGS. 1-13, the cutting assemblies 152 are equipped with a bar-shaped hammer 158. As shown in FIG. 16, the hammer 158 is generally rectangularly shaped, having two opposing ends 210, 212 and two opposing sides 211, 213. The sides 211, 213 have substantially the same size and shape so that they can be interchangeable. That is, in operation, the side 211 may initially face the direction of rotation of the impacting rotor 136, so that it applies a cutting or impacting force to material being processed by the impactor 100. After use of the side 211 for a period of time, the hammer 158 can be rotated 180 degrees about its longitudinal axis so that the side 213 then faces the direction of rotation. In this way, the side 213 can effectively replace the side 211 after a period of time, thereby extending the useful life of the hammer 158. Holes 214 are defined through the hammer 158 to align with the bolt pattern of the cutting blade 160 and the fan blade 162. Various embodiments of the hammer 158 may have different heights. For example, the hammer 158 may be in the range of about one inch tall in some embodiments, and in other embodiments, the height of the hammer 158 may be in the range of about two inches, where the processing of material by the impactor 158 may benefit from a shorter or taller hammer, as the case may be.

Figure 14:
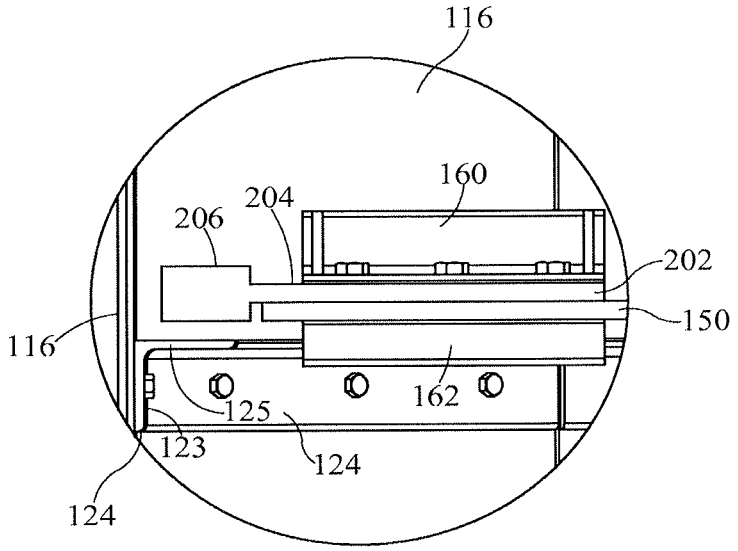
FIG. 14 is a simplified enlarged elevational view of another embodiment of the portion of FIG. 2 shown in FIG. 13.
Figure 17:
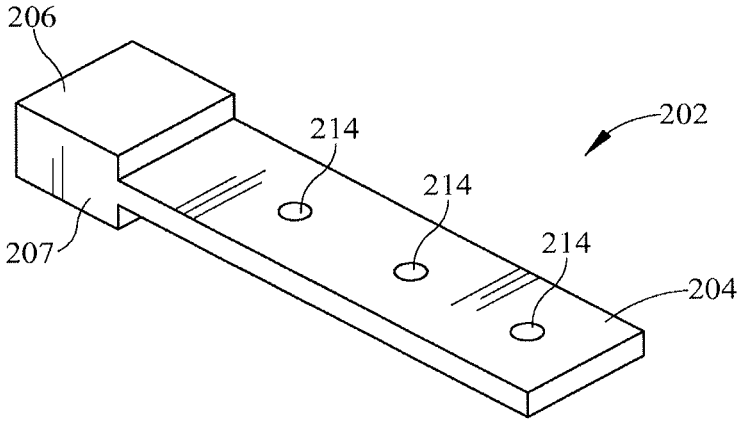
FIG. 17 is a simplified perspective view of another embodiment of a hammer for an impactor rotor.

The cutting assemblies 152 can support a variety of different hammer configurations, including the bar-shaped configuration 158 as well as a number of other hammer configurations, as shown in FIGS. 14-20. FIGS. 14 and 17 illustrate a mace-style hammer 202, which has a base portion 204 similar to the hammer 158, and a mallet 206 disposed at its distal end. The mallet 206 has opposing faces 207, either of which may face the direction of rotation of the impacting rotor 136. That is, either of the faces 207 of the hammer 202 can be used to impact material, simply by rotating the hammer 202 about its longitudinal axis. As shown in FIG. 14, the mallet 206 is sized larger (e.g., taller) than the base portion 204, but not so large that the desired vertical gap or clearance between the cutting assembly 152 and the cantilevered portion 125 of the shelf is affected. Generally speaking, each of the various possible hammer configurations is configured similarly in this regard. That is, the desired vertical gap or clearance between the cutting assembly 152 (or more specifically, the cutting disk 150) and the cantilevered portion 125 of the shelf 124 is maintained irrespective of the hammer configuration that is selected.

Figure 15:
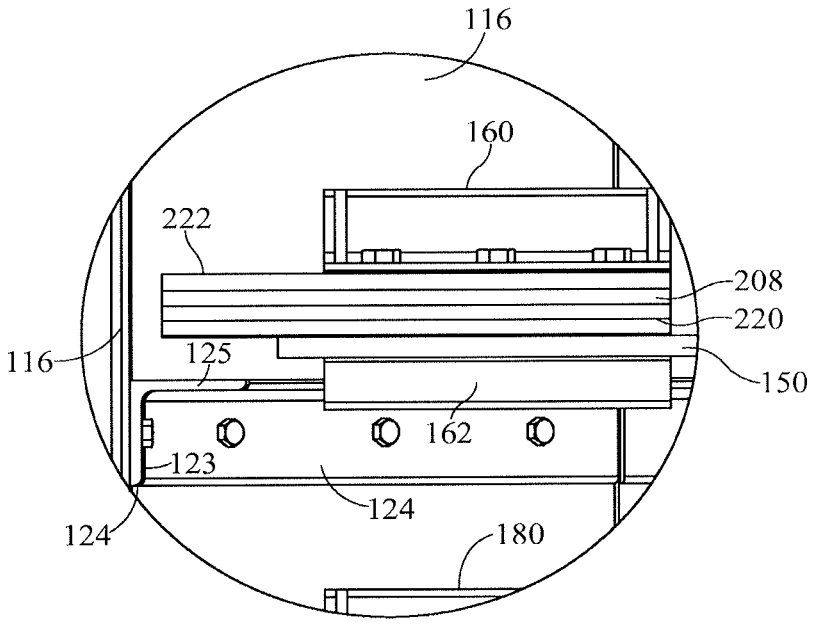
FIG. 15 is a simplified enlarged elevational view of another embodiment of the portion of FIG. 2 shown in FIG. 13.
Figure 18:
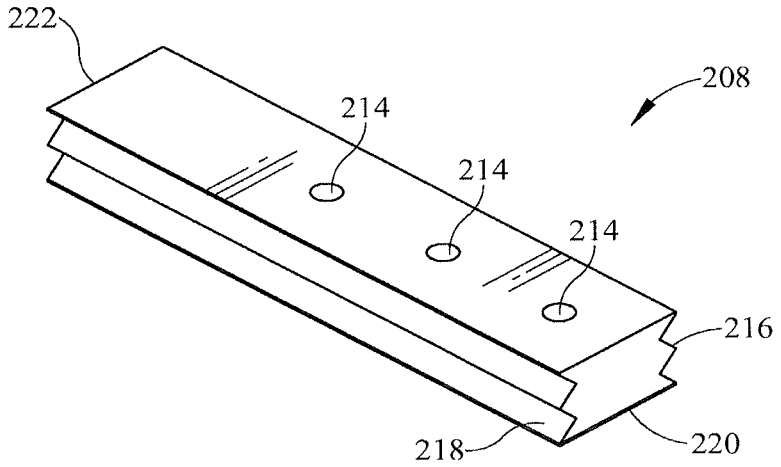
FIG. 18 is a simplified perspective view of another embodiment of a hammer for an impactor rotor.

Referring to FIGS. 15 and 18, a hammer 208 having a serrated-edge configuration is shown. The hammer 208 has generally the same configuration as the hammer 158, except that its sides 216, 218 are serrated. Much like the other hammer embodiments, the hammer 208 has an end 220 which is located nearer to the shaft 138 when the hammer 208 is installed in a cutting assembly 152 on the cutting disk 150, and a distal end 222 that extends horizontally outwardly past the outer or circumferential edge of the cutting disk 150. Also, as with the other hammers, the sides 216, 218 are interchangeable so that either side may face the direction of rotation of the impacting rotor 136.

Figure 19:
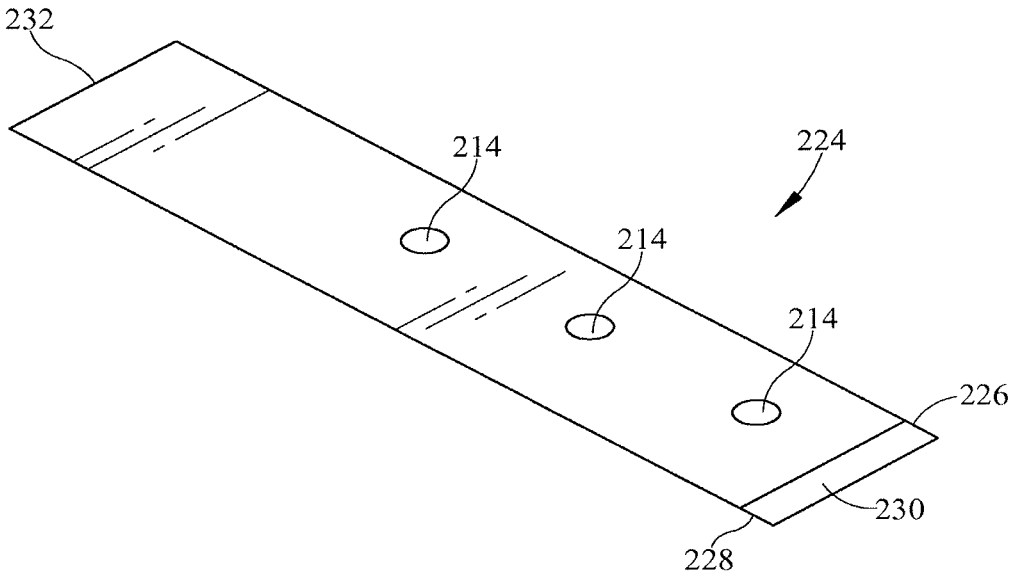
FIG. 19 is a simplified perspective view of another embodiment of a hammer for an impactor rotor.
Figure 20:
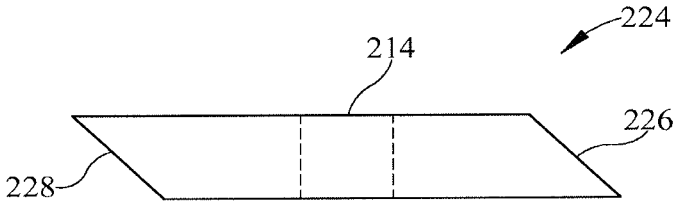
FIG. 20 is a simplified elevational view of the hammer of FIG. 19.

Referring now to FIGS. 19 and 20, a hammer 224 having a beveled-edge configuration is shown. The hammer 224 has generally the same configuration as the hammer 158, except that its sides 228, 226 are beveled. The bevel faces the direction of rotation of the impacting rotor 136, and the sides 228, 226 provide interchangeable impacting surfaces as described above.

Figure 21:
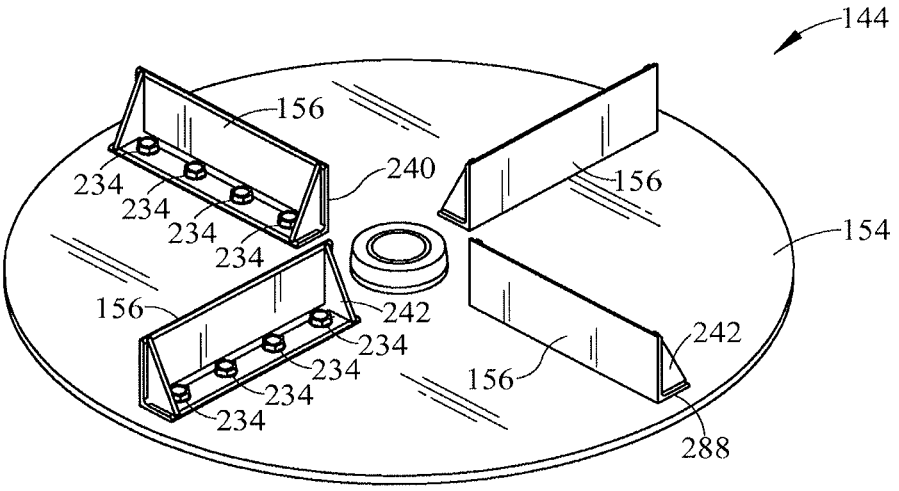
FIG. 21 is a simplified perspective view of at least one embodiment of an impeller rotor.
Figure 22:
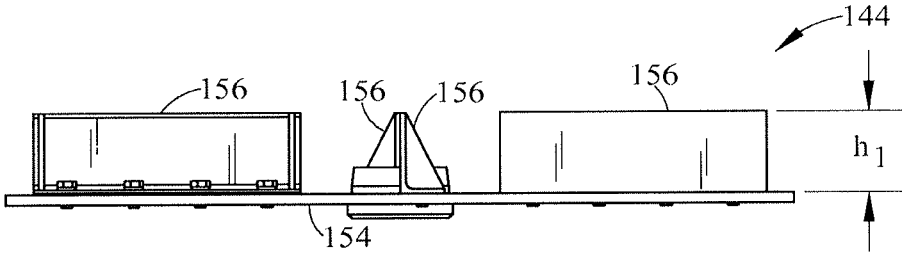
FIG. 22 is a simplified top plan view of the impeller rotor of FIG. 21.
Figure 23:
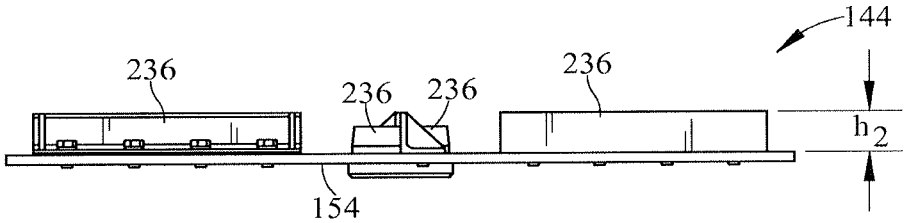
FIG. 23 is a simplified perspective view of at least one embodiment of a fan blade for the impeller rotor of FIG. 21.

Referring now to FIGS. 21-23, further details of the impeller rotor 144 are shown. The impeller rotor 144 includes a fan disk 154, which is generally planar and has a top surface that supports a number of fan blades 156 (e.g., four). Each of the fan blades 156 has a flange 238, which is mounted to the top surface of the fan disk 154 by a number of bolts 234. In the illustrative embodiment, the bolt pattern for the fan blades 156 includes a number of bolts e.g., four) arranged in a straight line. When mounted to the fan disk 154, the bolts 234 and thus the corresponding fan blade 156 is aligned with a ray extending from the center of the fan disk 154. Each of the fan blades 156 also has a blade portion 240 extending generally vertically upwardly (e.g., is cantilevered) from the flange 238 at an angle in the range of about 90 degrees. Each of the longitudinal ends of the blade portion 240 and the flange 238 are connected by a generally triangular end 242.

Based on the requirements of material to be processed by the impactor, or for other reasons, the fan blades 156 may be exchanged for fan blades having a taller or shorter height. For example, a fan blade 236 having a height $h_2$ that is shorter than a height $h_1$ of the fan blade 156 may be used in place of the fan blade 156 (e.g., to process heavier material more efficiently). Generally speaking, regarding the interchangeable components of the impacting assembly 126, different types of components can be used together or at the same time, in some embodiments. For example, in some embodiments, one impacting rotor 136 may be configured with four cutting assemblies 152 while another impacting rotor 136 of the same impacting assembly 126 may be configured with six or eight cutting assemblies 152. Further, within the individual rotors 136, 144, different types of components may be mixed, in some embodiments. For example, in some embodiments, an impacting rotor 136 may include both bar-style hammers and mace- or mallet-style hammers. As another example, an impeller rotor 144 may be configured with both fan blades 156 and fan blades 236 (e.g., two fan blades 156 and two fan blades 236). In these and other ways, the impactor 100 is highly adaptable to accommodate the processing of a wide variety of materials.

The foregoing disclosure is to be considered as exemplary and not restrictive in character, and all variations and modifications that come within the spirit of the disclosure are desired to be protected. Further, while aspects of the present disclosure may be described in the context of particular applications, it should be understood that the various aspects have other applications, for example, other devices that require the processing of materials for reuse.

The invention claimed is:

1. A vertical shaft impactor to process a plurality of different materials, the vertical shaft impactor comprising:

a housing defining an impacting chamber having a plurality of horizontal shelves secured to the periphery of the housing and extending into the impacting chamber; and an impacting assembly disposed in the impacting chamber, the impacting assembly comprising a vertical shaft supported by the housing, a plurality of rotors concentric with the shaft and rotatable relative to the housing, a plurality of receivers defined in the vertical shaft at predefined intervals along the vertical shaft, and a plurality of fasteners selectively disposable in respective ones of the plurality of receivers, each fastener including a protrusion for supporting one of the plurality of rotors along the shaft, the fasteners being movable to different receivers along the vertical shaft to vary the vertical position of the respective one of the plurality of rotors relative to the shaft.

2. The vertical shaft impactor of claim 1, wherein the plurality of rotors comprises a plurality of vertically spaced impacting rotors and an impeller rotor, and the impeller rotor is located vertically below the impacting rotors.

3. The vertical shaft impactor of claim 2, wherein each impacting rotor comprises a planar cutting disk and a selectable number of radially-extending cutting assemblies removably mounted to the cutting disk; and wherein each cutting assembly comprises a hammer supported by an upwardly facing top surface of the cutting disk, a cutting blade supported by the hammer, and a fan blade adjacent a downwardly facing lower surface of the cutting disk.

4. The vertical shaft impactor of claim 3, wherein the hammer, the cutting blade, and the fan blade each have through-holes that share a common spacing such that when the through-holes are aligned, the hammer, the cutting blade, and the fan blade may be collectively aligned with a corresponding bolt pattern through the cutting disk.

5. The vertical shaft impactor of claim 4, wherein the common bolt pattern comprises three bolts arranged in a straight line defined by a ray extending from the center of the vertical shaft.

6. The vertical shaft impactor of claim 3, wherein the cutting disk comprises a plurality of holes defined therein, and wherein the holes define a plurality of selectable mounting positions for the cutting assemblies.

7. The vertical shaft impactor of claim 3, wherein the selectable number of cutting assemblies is one of 4, 6, and 8, and the cutting assemblies are mounted to the cutting disk with an equal spacing about the disk, the interval between the cutting assemblies decreasing with an increase in the number of cutting assemblies.

8. The vertical shaft impactor of claim 3, wherein the cutting disk is configured to permit cutting assemblies to be added or removed to change the number of cutting assemblies mounted to the cutting disk.

9. The vertical shaft impactor of claim 3, wherein each of the cutting assemblies comprises a hammer, a cutting blade supported by the hammer, and a fan blade.

10. The vertical shaft impactor of claim 9, wherein each hammer is configured as one of a bar, a mallet, a beveled, and a serrated configuration.

11. The vertical shaft impactor of claim 3, wherein the hammer comprises a first cutting edge on a first side of the hammer and a second cutting edge on a second side of the hammer and spaced from the first cutting edge by a width of the hammer.

12. The vertical shaft impactor of claim 2, wherein the impeller rotor comprises a planar fan disk and a plurality of radially-extending fan blades mounted to an upwardly-facing top surface of the fan disk.

13. The vertical shaft impactor of claim 12, wherein the plurality of fan blades of the fan disk comprises a fixed number of fan blades.

14. The vertical shaft impactor of claim 13, wherein the fixed number of fan blades is 4.

15. The vertical shaft impactor of claim 12, wherein each fan blade of the fan disk has a flange mounted to the top surface of the fan disk and a blade portion extending vertically upwardly from the flange to define an angle of about 90 degrees with the flange.

16. The vertical shaft impactor of claim 15, wherein each fan blade has at least one triangular end connecting the flange with the blade portion.

17. The vertical shaft impactor of claim 15, wherein the blade portion has a vertical height configuration selectable from a plurality of vertical height configurations.

18. The vertical shaft impactor of claim 12, wherein each fan blade is mounted to the fan disk using a bolt pattern comprising four bolts arranged in a straight line defined by a ray extending from the center of the vertical shaft.

19. The vertical shaft impactor of claim 1, wherein the plurality of rotors are spaced from each other by a vertical distance that is variable.

20. The vertical shaft impactor of claim 1, wherein the plurality of rotors comprises first, second, and third impacting rotors, the first and second impacting rotors are vertically spaced by a first interval, the second and third rotors are vertically spaced by a second interval, and the second interval is not the same as the first interval.

* * * * *